United States Patent [19]

Thangavelu

[11] Patent Number: 4,846,311

[45] Date of Patent: Jul. 11, 1989

[54] OPTIMIZED "UP-PEAK" ELEVATOR CHANNELING SYSTEM WITH PREDICTED TRAFFIC VOLUME EQUALIZED SECTOR ASSIGNMENTS

[75] Inventor: Kandasamy Thangavelu, Avon, Conn.

[73] Assignee: Otis Elevator Company, Farmington, Conn.

[21] Appl. No.: 209,745

[22] Filed: Jun. 21, 1988

[51] Int. Cl.[4] ..... B66B 1/20

[52] U.S. Cl. ..... 187/125; 187/128

[58] Field of Search ..... 187/124, 125, 128, 130, 187/132

[56] References Cited

U.S. PATENT DOCUMENTS

| | | | |
|---|---|---|---|
| 3,857,465 | 12/1974 | Iwasaka et al. | 187/128 |
| 4,023,135 | 5/1977 | Hammura et al. | 340/1 R |
| 4,030,572 | 6/1977 | Kaneko et al. | 187/125 |
| 4,112,419 | 9/1978 | Kinoshita et al. | 187/131 |
| 4,244,450 | 1/1981 | Umeda et al. | 187/124 |
| 4,303,851 | 12/1981 | Mottier | 235/92 PK |
| 4,305,479 | 12/1981 | Bittar et al. | 187/125 |
| 4,323,142 | 4/1982 | Bittar | 187/127 |
| 4,330,836 | 5/1982 | Donofrio et al. | 187/131 |
| 4,363,381 | 12/1982 | Bittar | 187/127 |
| 4,411,338 | 10/1983 | Kuzunuki et al. | 187/124 |
| 4,458,787 | 7/1984 | Uetani | 187/127 |
| 4,473,134 | 9/1984 | Uetani | 187/124 |
| 4,499,975 | 2/1985 | Tsuji | 187/125 |
| 4,503,941 | 3/1985 | Takare | 187/128 |
| 4,523,665 | 6/1985 | Tsuji | 187/127 |
| 4,553,639 | 11/1985 | Uetani | 187/131 |
| 4,562,530 | 12/1985 | Umeda et al. | 364/148 |
| 4,567,558 | 1/1986 | Umeda et al. | 364/148 |
| 4,612,624 | 9/1986 | Tsuji | 364/581 |
| 4,663,723 | 5/1987 | Umeda | 187/125 X |
| 4,672,531 | 6/1987 | Uetani | 187/124 X |
| 4,677,577 | 6/1987 | Takabe et al. | 187/124 X |
| 4,691,808 | 9/1987 | Nowak et al. | 187/125 |

OTHER PUBLICATIONS

Forecasting Methods and Applications by Spyros Makridakis and Steven C. Wheelwright (JOhn Wiley & Sons, Inc., 1978), Sections 3.3: "Single Exponential Smoothing", 3.6: Linear Exponential Smoothing and 3.5: Linear Moving Averages.

*Primary Examiner*—Shoop, Jr. William M.
*Assistant Examiner*—W. E. Duncanson, Jr.

[57] ABSTRACT

An elevator system containing a group of elevator cars (1–4) and a group controller (32) having signal processing means (CPU) for controlling the dispatching of the cars from a main floor or lobby (L) in relation to different group parameters. During up-peak conditions, each car is dispatched from the main floor to an individual plurality of contiguous floors, defining a "sector" (SN). Sectors are contiguous, and the number of sectors may be less than the number of cars, and a floor can be assigned to more than one sector. Floors that constitute a sector assigned exclusively to a car are displayed on an indicator (SI) at the lobby. Cars are selected for assignment by grouping floors into sectors and appropriately selecting sectors, so that each elevator car handles more or less an equal predicted traffic volume during varying traffic conditions, resulting in the queue length and waiting time at the lobby being decreased, and the handling capacity of the elevator system increased. Estimation of future traffic flow levels for the various floors for, for example, each five (5) minute interval, are made using traffic levels measured during the past few time intervals on the given day as real time predictors, using a linear exponential smoothing model, and traffic levels measured during similar time intervals on previous days as historic traffic predictors, using a single exponential smoothing model. The combined estimated traffic is then used to group floors into sectors ideally having at least nearly equal traffic volume for each time interval.

34 Claims, 4 Drawing Sheets

MACHINE ROOM "MR"
MAIN FLOOR (LOBBY) "L"
SN = 3
SN = 2
SN = 1
13
10
9
5
5
2
FROM 40
PL
GROUP CONTROL
CPU
32
POS...CC
POS...CC
DRIVE & MOTION CONTROL
CPU
30
HC
LW
SI
CC
HC
U
D
14
12
16
18
1
2
3
4
SI
2-5
5-9
10-13

OPTIMIZED "UP-PEAK" ELEVATOR CHANNELING SYSTEM WITH PREDICTED TRAFFIC VOLUME EQUALIZED SECTOR ASSIGNMENTS

REFERENCE TO RELATED APPLICATIONS

This application relates to the same general subject matter, namely the use of contiguous floor channeling during up-peak periods in elevator car dispatching, as the following co-pending applications:

Ser. No. 157,542 filed Feb. 12, 1988, entitled "Contiguous Floor Channeling Elevator Dispatching" of Kandasamy Thangavelu, the inventor hereof, and Joseph Bittar, assigned to Otis Elevator Company, the assignee hereof; and Ser. No. 157,543 filed Feb. 12, 1988, entitled "Contiguous Floor Channeling With Up Hall Call Elevator Dispatching" of Kandasamy Thangavelu, the inventor hereof, and Joseph Bittar, also assigned to Otis Elevator Company, the assignee hereof being issued as U.S. Pat. No. 4,792,019 on Dec. 20, 1988.

This application also relates, inter alia to some of the traffic prediction aspects of Ser. No. 07/209,744, filed on June 21, 1988, entitled "Queue Based Elevator Dispatching System Using Peak Period Traffic Prediction" of Kandasamy Thangavelu, the inventor hereof, also assigned to Otis Elevator Company, the disclosure of which is incorporated herein by reference.

TECHNICAL FIELD

The present invention relates to the dispatching of elevator cars in an elevator system containing a plurality of cars providing group service to a plurality of floors in a building during "up-peak" conditions, and more particularly to a computer based system for optimizing the "up-peak" channeling for such a multi-car, multi-floor elevator system using "up-peak" traffic predictors on a floor by floor basis.

BACKGROUND ART

General Introduction

In a building having a group of elevators, elevator inter-floor traffic and traffic from a main floor (e.g. the lobby) to upper floors varies throughout the day. Traffic demand from the main lobby is manifested by the floor destinations entered by passengers (car calls) on the car call buttons.

Traffic from the lobby is usually highest in the morning in an office building. This is known as the "up-peak" period, the time of day when passengers entering the building at the lobby mostly go to certain floors and when there is little, if any, "inter-floor" traffic (i.e. few hall calls). Within the up-peak period, traffic demand from the lobby may be time related. Groups of workers for the same business occupying adjacent floors may have the same starting time but be different from other workers in the building. A large influx of workers may congregate in the lobby awaiting elevator service to a few adjacent or contiguous floors. Some time later, a new influx of people will enter the lobby to go to different floors.

During an up-peak period, elevator cars that are at the lobby frequently do not have adequate capacity to handle the traffic volume (the number of car calls) to the floors to which they will travel. Some other cars may depart the lobby with less than their maximum (full) loads. Under these conditions, car availability, capacity and destinations are not efficiently matched to the immediate needs of the passengers. The time it takes for a car to return to the lobby and pick up more passengers (passenger waiting time) expands, when these loading disparities are present.

In the vast majority of group control elevator systems in use, waiting time expansion is traceable to the condition that the elevator cars respond to car calls from the lobby without regard to the actual number of passengers in the lobby that intend to go to the destination floor. Two cars can serve the same floor, separated only by some dispatching interval (the time allowed to elapse before a car is dispatched). Dispatching this way does not minimize the waiting time in the lobby, because the car load factor (the ratio of actual car load to its maximum load) is not maximized, and the number of stops made before the car returns to the lobby to receive more passengers is not minimized.

In some existing systems, for instance U.S. Pat. No. 4,305,479 to Bittar et al entitled "Variable Elevator Up Peak Dispatching Interval," assigned to Otis Elevator Company, the dispatching interval from the lobby is regulated. Sometimes, this means that a car, in a temporary dormant condition, may have to wait for other cars to be dispatched from the lobby before receiving passengers who then enter car calls for the car.

To increase the passenger handling capacity per unit of time, the number of stops that a car can make may be limited to certain floors. Cars, often arranged in banks, may form a small group of cars that together serve only certain floors. A passenger enters any one of the cars and is permitted to enter a car call (by pressing a button on the car operating panel) only to the floors served by the group of cars. "Grouping", as this is commonly called, increases car loading, improving system efficiency, but does not minimize the round trip time back to the lobby. The main reason is that it does not force the car to service the lowest possible floor with the minimum number of stops before reaching that floor.

In some elevators, cars are assigned floors based on car calls that are entered from a central location. U.S. Pat. No. 4,691,808 to Nowak et al entitled "Adaptive Assignment of Elevator Car Calls," assigned to Otis Elevator Company, describes a system in which that takes place, as does Australian Pat. No. 255,218 granted in 1961 to Leo Port. This approach directs the passengers to cars.

General Approach of Invention

The present invention is directed to optimizing a still further approach, namely, channeling, in which the floors above the main floor or lobby are grouped into sectors, with each sector consisting of a set of contiguous floors and with each sector assigned to a car, with such an approach being used during up-peak conditions.

During up-peak elevator operation, such channeling has been used to reduce the average number of car stops per trip and the highest reversal floor. This has reduced the round trip time and has increased the number of car trips made, for example, during each five (5) minute period.

By this approach, to some degree, the maximum waiting time and service time have been reduced, and the elevator handling capacity has been increased. It has thus been possible to some degree to handle up-peak traffic using fewer and/or smaller cars for a particular building situation. However, the prior attempts to use such channeling to equalize the number of passengers handled by each sector has been done by selecting equal numbers of floors for each sector, which generally assumes that the traffic flow with time on a floor by floor basis is equal, which is not accurate for many building situations.

In contrast, rather than merely assigning an equal number of floors per sector, the present invention establishes a method of and system for estimating the future traffic flow levels of the various floors for, for example, each five (5) minute interval, and using these traffic predictors to more intelligently assign the floors to more appropriately configured sectors, having possibly varying numbers of floors or even over-lapping floors, to optimize the effects of up-peak channeling.

It is noted that some of the general prediction or forecasting techniques utilized in the present invention are discussed in general (but not in any elevator context or in any context analogous thereto) in *Forecasting Methods and Applications* by Spyros Makridakis and Steven C. Wheelwright (John Wiley & Sons, Inc., 1978), particularly in Section 3.3: "Single Exponential Smoothing" and Section 3.6: "Linear Exponential Smoothing."

DISCLOSURE OF INVENTION

The present invention thus originated from the need to provide optimal service during an up-peak period when up-peak channeling is used. An analysis done as part of the invention indicates that, by grouping floors into sectors and appropriately selecting sectors, so that each elevator car handles a more nearly equal total traffic volume during varying traffic conditions, the queue length and waiting time at the lobby can be decreased even more, and the handling capacity of the elevator system even further increased. The present invention in particular pertains to the methodology developed to achieve these advantageous objectives.

The current invention thus establishes an effective method of and system for estimating the future traffic flow levels of various floors for, for example, each five (5) minute interval, for enhanced channeling and enhanced system performance.

This estimation can be made using traffic levels measured during the past few time intervals on the given day, namely as "real time" predictors, and, when available, traffic levels measured during similar time intervals on previous days, namely "historic" predictors. The estimated traffic is then used to intelligently group floors into sectors, so that each sector ideally has equal traffic volume for each given five (5) minute period or interval.

Such intelligently assigned sectoring reduces passenger queues and the waiting times at the lobby by achieving more accurate uniform loading of the cars of the elevator system. The handling capacity of the elevator system is thus significantly increased.

Thus, by changing the sector configuration with, for example, each five (5) minute interval, by equalizing estimated traffic volume per sector, the time variation of traffic levels of various floors is appropriately served. Then, as a floor has increasing traffic volume, it has better service and often is included in two adjacent sectors.

When each sector serves equal traffic volume, the queue length and waiting time are reduced at the lobby. All cars thus are caused to carry a more nearly equal traffic volume, and thus the system has a higher handling capacity.

The invention's use of "today's" traffic data to predict future traffic levels provides for a quick response to the current day's traffic variations. The provision of allowing the inclusion of particularly busy floors in two sectors improves the frequency of service and decreases waiting time. Additionally, the preferred use of linear exponential smoothing in the real time prediction and of single exponential smoothing in the historic prediction, and the combining of both of them with varying multiplication factors to produce optimized traffic predictions also significantly enhance the efficiency and effectiveness of the system.

The invention may be practiced in a wide variety of elevator systems, utilizing known technology, in the light of the teachings of the invention, which are discussed in detail hereafter.

Other features and advantages will be apparent from the specification and claims and from the accompanying drawings which illustrate an exemplary embodiment of the invention.

BEST MODE FOR CARRYING OUT THE INVENTION

Exemplary Elevator Application

Figure 1:
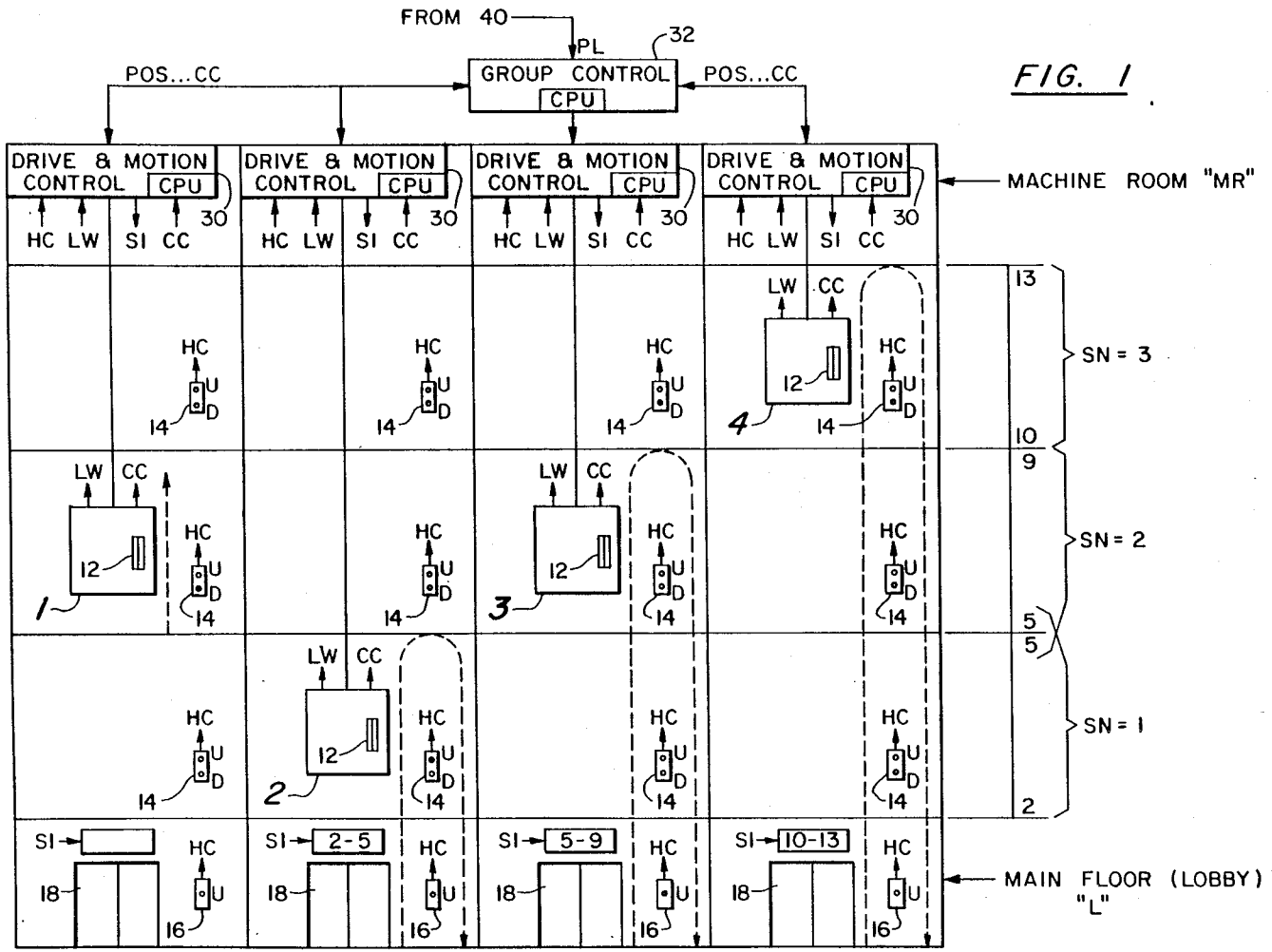
FIG. 1 is a functional block diagram of an exemplary elevator system including an exemplary four car "group" serving an exemplary thirteen floors

An exemplary multi-car, multi-floor elevator application or environment, with which the exemplary system of the present invention can be used, is illustrated in FIG. 1.

In FIG. 1, an exemplary four elevator cars 1–4, which are part of a group elevator system, serve a building having a plurality of floors. For the exemplary purpose of this specification, the building has an exemplary thirteen floors above a main floor, typically a ground floor lobby "L". However, some buildings have their main floor at the top of the building, in some unusual terrain situations, or in some intermediate portion of the building, and the invention can be analogously adopted to them as well.

Each car 1–4 contains a car operating panel 12 through which a passenger may make a car call to a floor by pressing a button, producing a signal "CC", identifying the floor to which the passenger intends to travel. On each of the floors there is a hall fixture 14 through which a hall call signal "HC" is provided to indicate the intended direction of travel by a passenger on the floor. At the lobby "L", there is also a hall call fixture 16, through which a passenger calls the car to the lobby.

The depiction of the group in FIG. 1 is intended to illustrate the selection of cars during an up-peak period, according to the invention, at which time the exemplary floors 2–13 above the main floor or lobby "L" are divided into an appropriate number of sectors, depending upon the number of cars in operation and the traffic volume, with each sector containing a number of contiguous floors assigned in accordance with the criteria and operation used in the present invention, all as explained more fully below. The floors in the building are thus divided into sectors, with it being possible that a particular floor may be assigned to more than one sector, all in an operation explained in more detail below in context with the flow charts of FIGS. 3 & 4.

If desired, only three of the cars 1–4 may be assigned, one to each of three sectors, leaving one car free. However, alternatively, the floors of the building may be divided into four sectors, in which case all four of the cars can be used to individually serve, for example, four sectors.

At the lobby, and located above each door 18, there is a service indicator "SI" for each car, which shows the temporary, current selection of available floors exclusively reachable from the lobby by a car based on the sector assigned to that car. That assignment changes throughout the up-peak period, as explained below, and for distinguishing purposes each sector is given a number "SN" and each car is given a number "CN".

Figure 3:
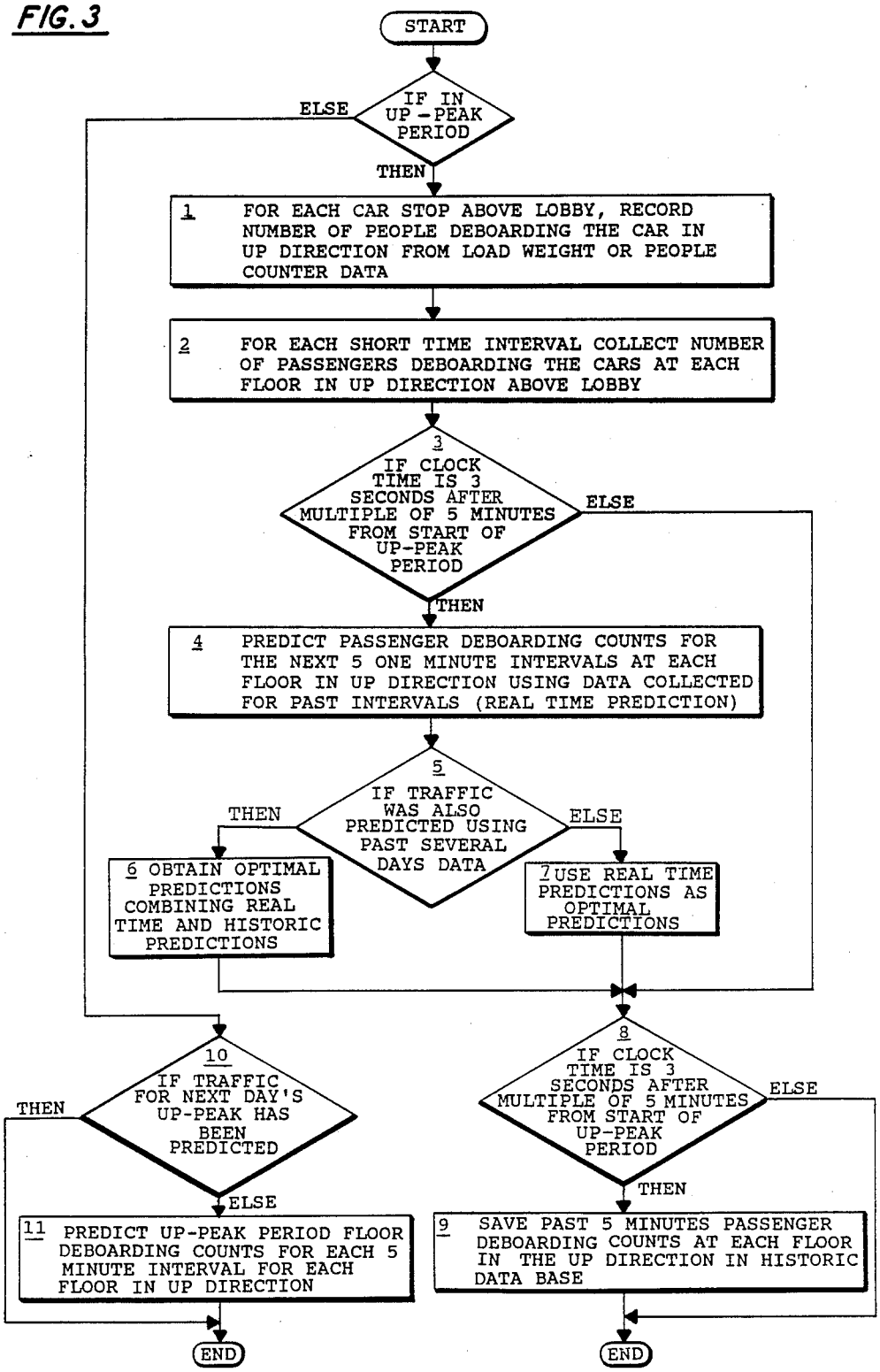
FIG. 3 is a logic flow chart diagram of software blocks illustrating the up-peak period floor traffic estimation methodology part of the dispatching routine used in the exemplary embodiment of the present invention.
Figure 4:
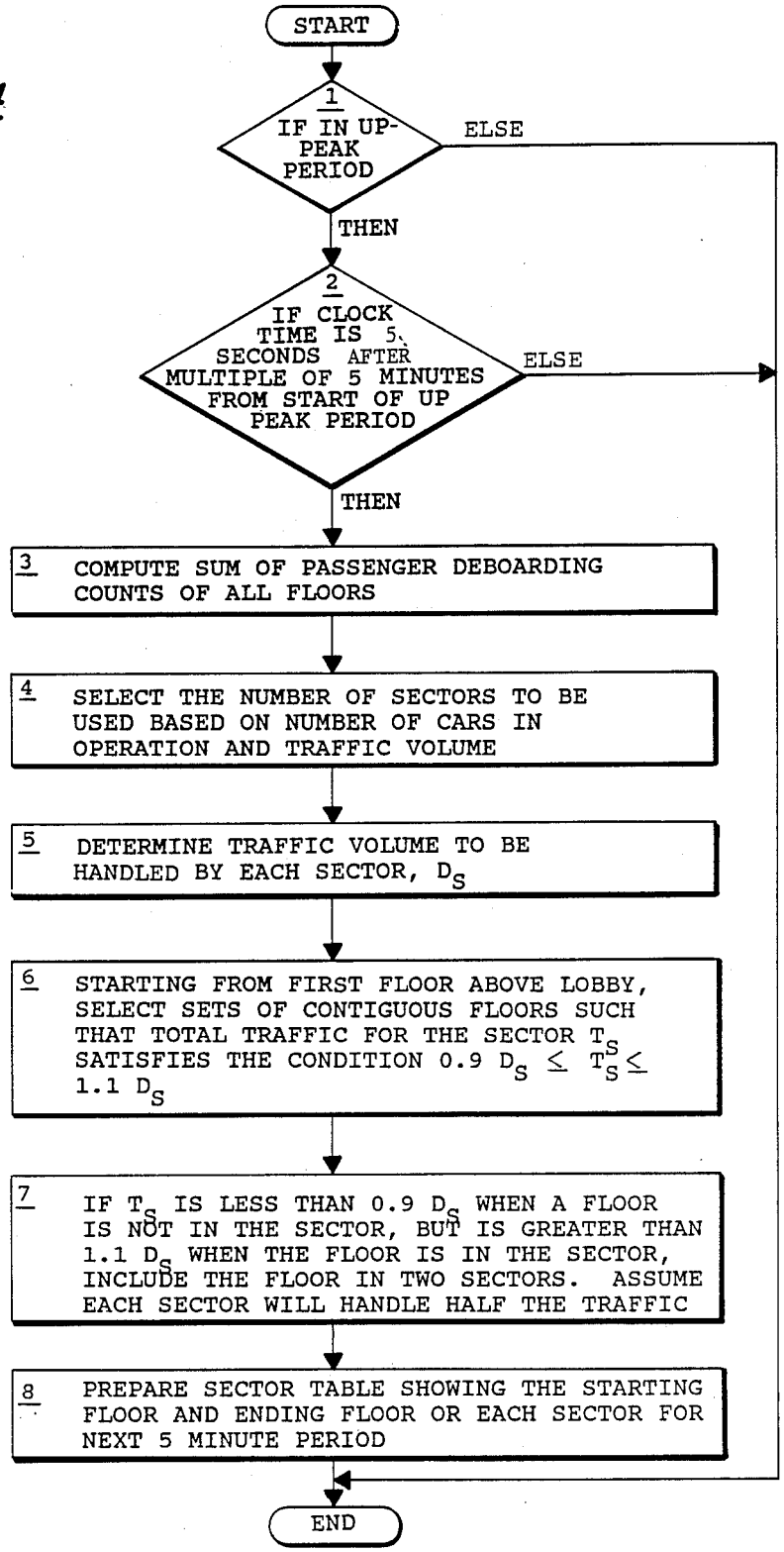
FIG. 4 is a logic flow chart diagram of software blocks illustrating the logic for forming sectors for the up-peak period used as a further part of the dispatching routine used in the exemplary embodiment of the present invention.

For exemplary purposes for a particular floor-sector-car assignment, it is assumed that for a particular day the up-peak de-boarding conditions of the system, when the algorithms or routines of FIGS. 3 & 4 are processed, will cause the following car sector floor assignments to be made. For example, assuming that car 1 is to be allowed to be unassigned to a sector, in the case of car 2 (CN=2), it is assigned to serve the first sector (SN=1). Car 3 (CN=3) will serve the second sector (SN=2), while car 4 (CN=4) serves the third sector (SN=3). As noted, car 1 (CN=1) is momentarily not assigned to a sector. The service indicator "SI" for car 2 will display, for example, floors 2–5, the presumed floors assigned to the first sector for this example, to which floors that car will exclusively provide service from the lobby —but possibly for one trip from the lobby. Car 3 similarly provides exclusive service to the second sector, consisting of the floors assigned to that sector, for example floors 5–9, and the indicator for car 3 will show those floors. The indicator for car 4 indicates for example floors 10–13, the floors assigned to the third sector under the presumed conditions. Thus, as can be seen from this example, the sectors can have different numbers of floors assigned to them (in the example four upper floors for SN=1, five upper floors for SN=2, and four upper floors for SN=3), with the first and second sectors both having the bridging fifth floor assigned to them due to the floor's high demand under the presumed exemplary conditions.

The service indicator for the car 1 is not illuminated, showing that it is not serving any restricted sector at this particular instant of time during the up-peak channeling sequence reflected in FIG. 1. Car 1, however, may have a sector assigned to it as it approaches the lobby at a subsequent time, depending on the position of the other cars at that time and the current assignment of sectors to cars and the desired parameters of the system.

Each car 1–4 will only respond to car calls that are made in the car from the lobby to floors that coincide with the floors in the sector assigned to that car. The car 4, for instance, in the exemplary assignments above, will only respond to car calls made at the lobby to floors 10–13. It will take passengers from the lobby to those floors (provided car calls are made to those floors) and then return to the lobby empty, unless it is assigned to a hall call.

Such a hall call assignment may be done using the sequences described in the above referred to co-pending application Ser. No. 157,542 (U.S. Pat. No. 4,792,019) entitled "Contiguous Floor Channeling With Up Hall Call Elevator Dispatching" by Thangavelu & Bittar.

As has been noted, the mode of dispatching of the present invention is used during an up-peak period. At other times of the day, when typically there is more "inter-floor" traffic, different dispatching routines may be used to satisfy inter-floor traffic and traffic to the lobby (it tends to build after the up-peak period, which occurs at the beginning of the work day). For example, the dispatching routines described in the below identified U.S. patents (the "Bittar patents", all assigned to Otis Elevator Company) may be used at other times in whole or in part in an overall dispatching system, in which the routines associated with the invention are accessed during the up-peak condition:

U.S. Pat. No. 4,363,381 to Bittar on "Relative System Response Elevator Call Assignments", and/or U.S. Pat. No. 4,323,142 to Bittar et al on "Dynamically Reevaluated Elevator Call Assignments."

As in other elevator systems, each car 1–4 is connected to a drive and motion control 30, typically located in the machine room "MR". Each of these motion controls 30 is connected to a group control or controller 32. Although it is not shown, each car's position in the building would be served by the controller through a position indicator as shown in the previous Bittar patents.

The controls 30, 32 contain a CPU (central processing unit or (signal processor) for processing data from the system. The group controller 32, using signals from the drive and motion controls 30, sets the sectors that will be served by each of the cars in accordance with the operations discussed below. Each motion control 30 receives the "HC" and "CC" signals and provides a drive signal to the service indicator "SI". Each motion control also receives data from the car that it controls on the car load "LW". It also measures the lapsed time while the doors are open at the lobby (the "dwell time", as it is commonly called). The drive and motion controls are shown in a very simplified manner herein because numerous patents and technical publications showing details of drive and motion controls for elevators are available for further detail.

The "CPUs" in the controllers 30, 32 are programmable to carry out the routines described herein to effect the dispatching operations of this invention at a certain time of day or under selected building conditions, and it is also assumed that at other times the controllers are capable of resorting to different dispatching routines, for instance, the routines shown in the aforementioned Bittar patents.

Owing to the computing capability of the "CPUs", this system can collect data on individual and group demands throughout the day to arrive at a historical record of traffic demands for each day of the week and compare it to actual demand to adjust the overall dispatching sequences to achieve a prescribed level of system and individual car performance. Following such an approach, car loading and lobby traffic may also be analyzed through signals "LW", from each car, that indicates the car load.

Actual lobby traffic may also be sensed by using a people sensor (not shown) in the lobby. U.S. Pat. Nos. 4,330,836 to Donofrio et al on an "Elevator Cab Load Measuring System" and 4,303,851 to Mottier on a "People and Object Counting System", both assigned to Otis Elevator Company, show approaches that may be employed to generate these signals. Using such data and correlating it with the time of day and the day of the week and the actual entry of car calls and hall calls, a meaningful demand demograph can be obtained for allocating floors to the sectors throughout the up-peak period in accordance with the invention by using signal processing routines that implements the sequences described in the flow charts of FIGS. 3 & 4, described more fully below, in order to minimize the queue length and waiting time at the lobby.

In discussing the dispatching of cars to sectors using the assignment scheme or logic illustrated in FIGS. 3 & 4, it is assumed (for convenience) that the elevator cars 1–4 are moving throughout the building, eventually returning to the lobby (the main floor serving the upper floors) to pick up passengers.

Exemplary Dispatching System of Invention

As noted above, the present invention originated from the need to provide optimal service during an up-peak period when up-peak channeling is used.

An analysis done as part of the invention indicates that, by appropriately selecting sectors so that each car 1–4 handles more or less an equal traffic volume during varying traffic conditions, the queue length and waiting time at the lobby "L" can be decreased, and the handling capacity of the system increased. The methodology developed to achieve this objective will be described in connection with FIGS. 2–4.

Figure 2:
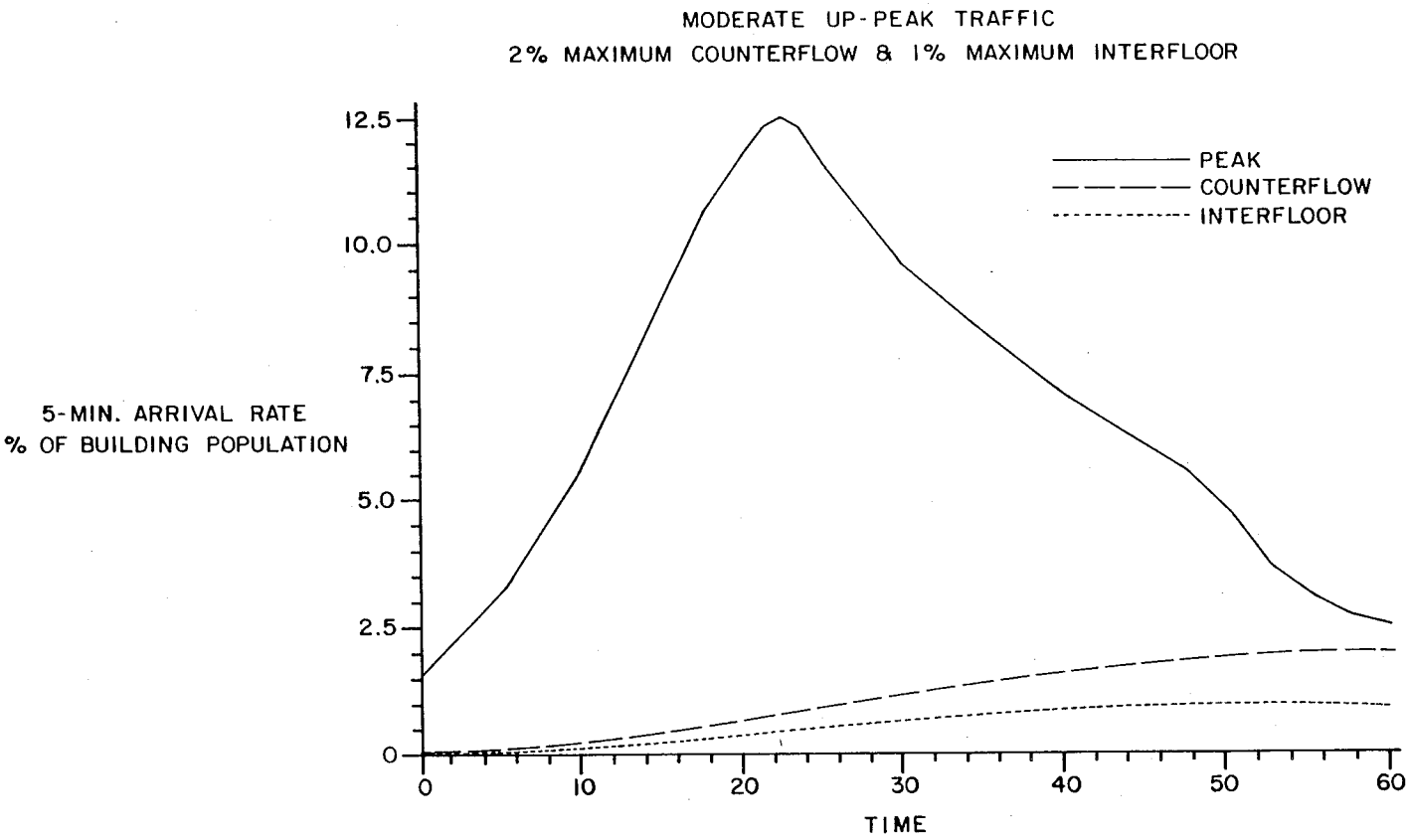
FIG. 2 is a graphical illustration showing the up-peak period traffic variation in a graph of an exemplary five (5) minute arrival rate percent of building population vs. time, graphing the peak, counterflow and inter-floor values.

FIG. 2 shows an exemplary variation of traffic during the up-peak period at the lobby, graphing the peak, the counterflow and the inter-floor figures. Above the lobby "L" the traffic reaches its maximum value at different times at different floors, depending on the office starting hours and the use of the floors. Thus, as may be seen, while traffic to some floors is rapidly increasing, the traffic to other floors may be steady or increasing slowly or even decreasing.

FIG. 3 illustrates in flow chart form the exemplary methodology used in the exemplary embodiment of the present invention to collect and predict passenger traffic at each floor for, for example, each five (5) minute interval during the up-peak period.

In summary, as can be abstracted from the logic flow chart and the foregoing, during up-peak periods, the de-boarding counts are collected for short time intervals at each floor above the lobby. The data collected "today" is used to predict de-boarding counts during, for example, the next few minutes for, for example, a five (5) minute interval, at each floor using preferably a linear exponential smoothing model or other suitable forecasting model.

As can be seen in FIG. 2, the traffic data during up-peak has a definite trend or pattern. If a simple moving average based on several observations were used, it would result in predictions that substantially lag behind the actual observations. Thus, such predictions cannot be used to efficiently dispatch the cars and provide quality service. Single exponential smoothing, which is based on a single moving average, has the same deficiency.

A forecasting method based on a double moving average, known as the linear moving average method (see Section 3.5 of the Makridakis/Wheelwright treatise referred to above), could be used. Such a method corrects for the lag using the difference between the first and second moving averages. However, since the method of moving averages requires saving relatively large amounts of data requiring a relatively large memory, a method known as "linear exponential smoothing" preferably is used. This method is based on two exponentially smoothed values. For a further understanding of this model, reference is had to the Makridakis/-Wheelwright treatise, particularly Section 3.6.

The use of this linear exponential smoothing in real time prediction or forecasting results in a rapid response to today's variations in traffic.

The traffic is also predicted or forecast during off-peak periods, for, for example, each five (5) minute up-peak interval, using data collected during the past several days for such interval and using the "single exponential smoothing" model. For a further understanding of this model, reference again is had to the Makridakis/Wheelwright treatise, particularly Section 3.3.

When this historic prediction is available, it is preferably combined with real time prediction to arrive at the optimal predictions or forecasts using the relationship:

$$X = ax_h + bx_r$$

where "X" is the combined prediction, "$x_h$" is the historic prediction and "$x_r$" is the real time prediction for the five (5) minute interval for the floor, and "a" and "b" are multiplication factors, whose summation is unity ($a+b=1$). The relative values of these multiplication factors preferably are selected as described below, causing the two types of predictors to be relatively weighted in favor of one or the other, or given equal weight if the "constants" are equal, as desired.

The relative values for "a" & "b" can be determined as follows. When the up-peak period starts, the initial predictions preferably assume that $a=b=0.5$. The predictions are made at the end of each minute, using the past several minutes data for the real time prediction and the historic prediction data.

The predicted data for, for example, six minutes is compared against the actual observations at those minutes. If at least, for example, four observations are either positive or negative and the error is more than, for example, twenty (20%) percent of the combined predictions, then the values of "a" & "b" are adjusted. This adjustment is made using a "look-up" table generated, for example, based on past experience and experimentation in such situations. The look-up table provides relative values, so that, when the error is large, the real time predictions are given increasingly more weight. An exemplary, typical look-up table is presented below.

| | Values for | |
|---|---|---|
| Error | a | b |
| 20% | 0.40 | 0.60 |
| 30% | 0.33 | 0.67 |
| 40% | 0.25 | 0.75 |

-continued

| Error | Values for a | Values for b |
|---|---|---|
| 50% | 0.15 | 0.85 |
| 60% | 0.00 | 1.00 |

These values would typically vary from building to building and may be "learned" by the system by experimenting with different values and comparing the resulting combined prediction against the actual, so that, for example, the sum of the square of the error is minimized. Thus, the prediction factors "a" & "b" are adaptively controlled or selected.

This combined prediction is made in real time and used in selecting the sectors for optimized up-peak channeling. The inclusion of real time prediction in the combined prediction results in a rapid response to today's variation in traffic.

Of course, as is well known to those of ordinary skill in the art, the controller includes appropriate clock means and signal sensing and comparison means from which the time of day and the day of the week and the day of the year can be determined and which can determine the various time periods which are needed to perform the various algorithms of the present invention.

In greater detail and with particular reference to the logic steps of FIG. 3, at the start, if the system shows that the up-peak period is in effect, in Step 1 the number of people de-boarding the car for each car stop above the lobby "L" in the up direction is recorded using the changes in load weight "LW" or people counting data. Additionally, in Step 2 for each short time interval the number of passengers or people de-boarding the cars at each floor in the up direction above the lobby is collected. Then, in Step 3, if the clock time is a few seconds (for example, three seconds) after a multiple of five (5) minutes from the start of the up-peak period, in Step 4 the passenger de-boarding counts for the next five one minute intervals are predicted at each floor in the up direction, using the data previously collected for the past intervals, producing a "real time" prediction ($x_r$). Else, if the clock time is not three seconds after a multiple of five (5) minutes from the start of the up-peak period, the algorithm proceeds directly to Step 8.

Then, continuing after Step 4 to Step 5, if the traffic was also predicted using the historic data of the past several days and hence the historic prediction ($x_h$) is available, then in Step 6, optimal predictions are obtained by directly combining the real time ($x_r$) and the historic ($x_h$) predictions, with the values of the "constants" equalized (a=b=0.5), or with the real time and the historic predictors relatively weighted, if so desired. Otherwise, if the historic data has not yet been generated, in Step 7 only the real time predictions are used as the optimal predictions.

Finally, whether the results are obtained through Step 6 or Step 7 or, if back in Step 3 the clock time was not three seconds after a multiple of five (5) minutes from the start of the up-peak period; in Step 8, if the clock time is a few seconds (for example, three seconds) after a multiple of five (5) minutes from the start of the up-peak period, then the passenger de-boarding counts at each floor in the up direction for the past five (5) minutes is saved and stored in the "historic" data base, and the algorithm is ended. If in Step 8 the clock time is not three seconds after a five (5) minute multiple from the start of the up-peak period, then the algorithm is immediately ended from Step 8.

On the other hand, if in the initial start of the algorithm the system indicated that the up-peak period was not present, Step 10 is performed. In Step 10, if the traffic for the next day's up-peak has been predicted, then the algorithm is ended. If not, in Step 11 the floor de-boarding counts for the up-peak period for each five (5) minute interval is predicted for each floor in the up direction, using the past several days data and the exponential smoothing model, and the algorithm then ended.

After the algorithm or routine of FIG. 3 is ended, it is thereafter restarted and cyclically repeated.

FIG. 4 illustrates in flow chart form the logic used in the exemplary embodiment of the present invention for selecting the floors for forming sectors for each exemplary five (5) minute interval.

As illustrated, if in the initiating Step 1 an up-peak condition exists, in Step 2, if it is only a few seconds (for example five seconds) after the start of a five (5) minute interval, then in Step 3 the optimal predictions of the passenger de-boarding counts at each floor above the lobby in the up direction are summed up, with the sum being considered equal to a variable "D".

In Step 4 the number of sectors to be used is then selected based on the total de-boarding counts of all floors and the number of cars in operation, using, for example, previous simulation results and/or past experience. If "D" is large, usually a larger number of sectors is used. Similarly, if the number of cars is fewer than normal, the number of sectors may be reduced. By this approach the average traffic to be handled by each sector is computed and denoted by "$D_S$". Based on the exemplary elevator system illustrated in FIG. 1, the number of sectors might equal three.

In Steps 6 & 7 the floors forming the sectors are then selected considering successive floors, starting from the first floor above the lobby "L", namely at the second floor. The following exemplary criteria is applied during this consideration in these two steps.

The successive floors are included in the sector then under consideration, as long as the total traffic for that sector "$T_S$" is less than "$D_S$" (namely $T_S<D_S$).

If "$T_S$" exceeds "$D_S$" plus some assigned additional amount as a maximum deviation, for example, ten percent (10%), (namely, $T_{S<1.1DS}$) the traffic without the last floor included in the sector is considered. If this resultant "$T_S$" is greater than, for example, ninety percent (90%) of "$D_S$" (namely $T_S>0.9D_S$), then the last floor is not included in the sector.

On the other hand, if the resultant "$T_S$" is less than ninety percent (90%) "$D_S$", used as the lower limit of the allowed range, then the last floor is included in this sector. It is also selected as the first floor for the next sector. Thus, as indicated for the fifth floor in the exemplary system of FIG. 1, one floor having relatively large demand can be included in two sectors, thus increasing the frequency of service to that floor. This has the effect of decreasing passenger waiting time to this floor. When a bridging floor is used in two contiguous sectors, in the calculation of "$T_S$" for the successive sector, it is preferably presumed that this successive sector will handle half the predicted traffic for that particular bridging floor.

In Step 8 the starting and ending floors of each sector are then saved in a table. The table is used by the up-peak channeling logic of the controller to display the floors served by the cars, namely in the exemplary system of FIG. 1, the "SI" for each car 2–4 will display their assigned floors for their respective sectors. The algorithm or routine of FIG. 4 will then end, to thereafter be restarted and cyclically sequentially repeated.

By changing the sector configuration with each five (5) minute interval, the time variation of traffic levels of various floors is appropriately served. Thus, if a floor has increasing traffic volume, it has better service and often is included in two sectors. The provision to include busy floors in two sectors improves the frequency of service and decreases waiting time.

As previously mentioned, when each sector serves equal traffic volume, the queue length and waiting time are reduced at the lobby. All cars carry more or less an equal traffic volume, that is a more nearly equal traffic volume, and thus the system has higher handling capacity.

Additionally, the use of today's traffic data to predict future traffic levels provides for a quick response to the current day's traffic variations.

An exemplary set of up-peak traffic conditions, with three cars available for sector assignments for a thirteen floor building with the "constants" being equalized (a=b=0.5), which would produce the car/floor/sector assignments of FIG. 1 though the dispatching routines of FIGS. 3 & 4, are tabulated below:

| Fl. # | X | $D_S$ | $T_S$ | CN | SN |
|---|---|---|---|---|---|
| L | — | — | — | — | — |
| 2 | 8 | 34 | 08 | 2 | 1 |
| 3 | 6 | 34 | 14 | 2 | 1 |
| 4 | 5 | 34 | 19 | 2 | 1 |
| 5 | 30 | 34 | 49 (15) | 2,3 | 1,2 |
| 6 | 7 | 33 | 22 | 3 | 2 |
| 7 | 3 | 33 | 25 | 3 | 2 |
| 8 | 2 | 33 | 27 | 3 | 2 |
| 9 | 5 | 33 | 32 | 3 | 3 |
| 10 | 4 | 33 | 04 | 4 | 3 |
| 11 | 25 | 33 | 29 | 4 | 3 |
| 12 | 3 | 33 | 32 | 4 | 3 |
| 13 | 2 | 33 | 34 | 4 | 3 |

While the foregoing is a description of the exemplary best mode for carrying out the invention and also describes some exemplary variations and modifications that may be made to the invention in whole or in part, it should be understood by one skilled in the art that many other modifications and variations may be made to the apparatus and the programs described herein without departing from the true scope and spirit of the invention.

Having thus described at least one exemplary embodiment of the invention, that which is new and desired to be secured by Letters Patent is claimed below.

I claim:

1. An elevator system, including a plurality of cars for transporting passengers from a main floor to a plurality of contiguous floors spaced from the main floor;

car call means for entering car calls for each car;

indicating means at the main floor for indicating the intended floor stops for each car;

car motion control means for moving each car;

traffic volume measuring means for measuring data related to the traffic volume on a per floor basis upon which varying estimated traffic volumes are made;

memory means for recording values based at least in part on data measured by said traffic volume measuring means; and a controller, with which said traffic volume measuring means and said memory means are associated, for providing signals that control the operation of the motion control and the indicating means in response to the car calls, characterized in that said controller comprises:

signal processing means for providing signals for determining when the system is in an up-peak condition and, when such up-peak condition exists, for providing further signals for dividing the floors in the building into a plurality of sectors, no greater in number than the plurality of cars, each sector comprising at least one floor, with multiple floors being contiguous floors, with the sectors being contiguous with each other, with the floors being assigned to the sectors to at least nearly equalize the estimated total traffic volumes among the sectors during a cycle of a first cyclical assignment sequence that assigns a floor to a sector during one cycle based on estimated values based at least in part on the traffic volume related data measured by said traffic volume measuring means measured during the last relatively short period of time of the order of no more than some minutes;

for assigning a sector to a car during a cycle of a further cyclical assignment sequence that assigns each sector to a car during one cycle;

for allowing a car to which a sector has been assigned to move away from the main floor in response to car calls only if the car calls are to floors in the sector assigned to the car; and for indicating on the indicating means the floors in a sector assigned to that car.

2. The elevator system according to claim 1, characterized in that said first sequence comprises:

determining the total estimated average traffic volume to be handled by each sector ($D_S$); and starting with a floor in an extreme location with respect to the main floor and proceeding to successive floors from there, assigning successive floors to the sector under consideration based on a selected relationship between the total traffic for the sector ($T_S$) and $D_S$ until all the floors have been assigned to at least one sector.

3. The elevator system according to claim 2, wherein said selected relationship is based at least in part on a maximum deviation of $T_S$ with respect to $D_S$, characterized in that said first sequence further comprises:

assigning successive floors to the sector under consideration as long as $T_S$ is within an upper limit of a range, this upper limit being the sum of $D_S$ and said maximum deviation of $T_S$ with respect to $D_S$ until all the floors have been assigned to at least one sector.

4. The elevator system according to claim 3, wherein said selected relationship of a maximum deviation of $T_S$ with respect to $D_S$ defines both the upper and lower limits of the allowed range, characterized in that said first sequence further comprises:

assigning successive floors to the sector under consideration as long as $T_S$ is within the upper limit of said range, but when the upper limit of said range is exceeded when $T_S$ is less than the allowed lower limit of the range defined as the difference of $D_S$ and the maximum deviation when a particular floor is not included in the sector under consideration, assigning that particular floor both to the sector under consideration as well as to the next contiguous sector to be considered, but when $T_S$ is greater than the allowed lower limit of said range when said particular floor is excluded in the sector under consideration, assigning that particular floor to the next contiguous sector.

5. The elevator system according to claim 4, wherein said maximum deviation of the upper and lower limits of the range of $T_S$ with respect to $D_S$ is of the order of about +ten percent (10%).

6. The elevator system according to claim 2, wherein said passenger volume measuring means includes recording means for recording the number of people de-boarding each car going to floors other than the main floor at least during up-peak conditions, characterized in that the determination of the total traffic volume to be handled by each sector ($D_S$) in said first sequence comprises:

computing the sum of the passenger de-boarding counts of all the floors; and selecting the number of sectors to be used based on the number of cars in operation combined with the traffic volume which is considered to exist at that point in time.

7. The elevator system according to claim 1, wherein said passenger volume measuring means includes recording means for recording the number of people de-boarding each car going to floors other than the main floor at least during up-peak conditions, characterized in that said first sequence comprises:

collecting the number of passengers de-boarding the cars at each floor for cyclical short time intervals; and saving the past passenger de-boarding counts at each floor in a data base to provide a recent past history of passenger volume.

8. The elevator system according to claim 7, characterized in that said first sequence further comprises:

predicting passenger de-boarding counts for the next short time period of the order of no more than some few minutes using data collected for recently past like short time periods during that same day, providing a real time prediction.

9. The elevator system according to claim 8, wherein said recording means for recording the number of people de-boarding each car going to floors other than the main floor at least during up-peak conditions retains the recorded data for each day for at least a period of some similar days and produces historic predictions using the past few days data, characterized in that said first sequence further comprises:

obtaining optimal predictions combining both real time predictions and historic predictions.

10. The elevator system according to Claim 9, characterized in that said first sequence further comprises:

combining both real time predictions and historic predictions in accordance with the following relationship $$X = ax_{h+bxr}$$

where "X" is the combined prediction, "$x_h$" is the historic prediction and "$x_r$" is the real time prediction for the short time period for the floor, and "a" and "b" are multiplying factors.

11. The elevator system according to claim 1, wherein said multiplying factors added together equal unity and provide relative weighing between the historic prediction and the real time prediction in the combined prediction.

12. The elevator system according to claim 1, wherein various values of said multiplying factors are provided in a look-up table and provide relative weighing between the historic prediction and the real time prediction in the combined prediction based on a comparison of the amount of error between predictions based on previously assigned values of "a" & "b" and actual observations over a relatively short time period of a few minutes.

13. The elevator system according to claim 12, wherein "b" is increased in value and "a" is decreased in value as the amount of error increases in the look-up table.

14. The elevator system according to claim 10, characterized in that said historic prediction of passenger de-boarding counts for the next short time period of said first sequence is based on:

a single exponential smoothing model.

15. The elevator system according to claim 8, characterized in that said prediction of passenger de-boarding counts for the next short time period of the order of no more than some few minutes using data collected for past like short time periods during that same day, providing a real time prediction of said first sequence is based on:

a linear exponential smoothing model.

16. The elevator system according to claim 8, wherein said short time period is of the order of about a five (5) minute interval.

17. An elevator dispatcher for controlling the assignment of car calls among a plurality of elevator cars serving a plurality of floors in a building in response to car calls made at a main floor to floors spaced from the main floor, in association with traffic volume measuring means for measuring the traffic volume on a per floor basis, and for controlling an indictor at the main floor that is capable of indicating the floors to which each car may travel, characterized by:

signal processing means for providing signals for determining when the system is in an up-peak condition and, when such up-peak condition exists, for providing further signals;

for dividing the floors in the building into a plurality of sectors, no greater in number than the plurality of cars, each sector comprising one or more contiguous floors, with the sectors being contiguous with each other, with the floors being assigned to the sectors to at least nearly equalize the total traffic volumes among the sectors during a cycle of a first cyclical assignment sequence that assigns a floor to a sector during one cycle based on estimated traffic volume values based at least in part on the traffic volume related data measured by said traffic volume measuring means measured during the last relatively short period of time of the order of no more than some minutes;

for assigning a sector to a car during a cycle of a further cyclical assignment sequence that assigns each sector to a car during one cycle;

for allowing a car to move away from the main floor in response to car calls only if the car calls are to floors in the sector assigned to the car; and for indicating on the indicating means by car the floors in a sector assigned to that car.

18. The elevator dispatcher according to claim 17, characterized in that said first sequence comprises:

determining the total traffic volume to be handled by each sector ($D_S$); and starting with a floor in an extreme location with respect to the main floor and proceeding to successive floors from there, assigning successive floors to the sector under consideration based on a selected relationship between the total traffic for the sector ($T_S$) and $D_S$ until all the floors have been assigned to at least one sector.

19. The elevator dispatcher according to claim 18, Wherein said selected relationship is based at least in part on a maximum deviation of $T_S$ with respect to $D_S$, characterized in that said first sequence further comprises:

assigning successive floors to the sector under consideration as long as $T_S$ is within an upper limit of a range, this upper limit being the sum of $D_S$ and said maximum deviation of $T_S$ with respect to $D_S$ until all the floors have been assigned to at least one sector.

20. The elevator dispatcher according to claim 19, wherein said selected relationship of a maximum deviation of $T_S$ with respect to $D_S$ defines both upper and lower limits of the allowed range, characterized in that said first sequence further comprises:

assigning successive floors to the sector under consideration as long as $T_S$ is within the upper limit of said range, but when the upper limit of said range is exceeded when $T_S$ is less than the allowed lower limit of the range defined as the difference of $D_S$ and the maximum deviation when a particular floor is not included in the sector under consideration, assigning that particular floor both to the sector under consideration as well as to the next contiguous sector to be considered, but when $T_S$ is greater than the allowed lower limit of said range when said particular floor is excluded in the sector under consideration, assigning that particular floor to the next contiguous sector.

21. The elevator dispatcher according to claim 20, wherein said maximum deviation of the upper and lower limits of the range of $T_S$ with respect to $D_S$ is of the order of about ±ten percent (10% ).

22. The elevator dispatcher according to claim 18, wherein said passenger volume measuring means includes recording means for recording the number of people de-boarding each car going to floors other than the main floor at least during up-peak conditions, characterized in that the determination of the total traffic volume to be handled by each sector ($D_S$) in said first sequence comprises:

computing the sum of the passenger de-boarding counts of all the floors; and selecting the number of sectors to be used based on the number of cars in operation combined with the traffic volume which is considered to exist at that point in time.

23. The elevator dispatcher according to claim 17, wherein said passenger volume measuring means includes recording means for recording the number of people deboarding each car going to floors other than the main floor at least during up-peak conditions, characterized in that said first sequence comprises:

collecting the number of passengers de-boarding the cars at each floor for cyclical short time intervals; and saving the past passenger de-boarding counts at each floor in a data base to provide a recent past history of passenger volume.

24. The elevator dispatcher according to claim 23, characterized in that said first sequence further comprises:

predicting passenger de-boarding counts for the next short time period of the order of no more than some few minutes using data collected for past like short time periods during that same day providing a real time prediction.

25. The elevator dispatcher according to claim 24, wherein said recording means for recording the number of people de-boarding each car going to floors other than the main floor at least during up-peak conditions retains the recorded data for each day for at least a period of some similar days and produces historic predictions using the past few days data, characterized in that said first sequence further comprises:

obtaining optimal predictions combining both real time predictions and historic predictions.

26. The elevator dispatcher according to claim 25, characterized in that said first sequence further comprises:

combining both real time predictions and historic predictions in accordance with the following relationship $$X = ax_h + bx_r$$

where "X" is the combined prediction, "$x_h$" is the historic prediction and "$x_r$" is the real time prediction for the short time period for the floor, and "a" and "b" are multiplying factors.

27. The elevator dispatcher according to claim 26, wherein said multiplying factors added together equal unity and provide relative weighing between the historic prediction and the real time prediction in the combined prediction.

28. The elevator dispatcher according to claim 27, wherein various values of said multiplying factors are provided in a look-up table and provide relative weighing between the historic prediction and the real time prediction in the combined prediction based on a comparison of the amount of error between predictions based on previously assigned values of "a" & "b" and actual observations over a relatively short time period of a few minutes.

29. The elevator dispatcher according to claim 28, Wherein "b" is increased in value and "a" is decreased in value as the amount of error increases in the look-up table.

30. The elevator dispatcher according to claim 26, characterized in that said historic prediction of passenger de-boarding counts for the next short time period of said first sequence is based on:

a single exponential smoothing model.

31. The elevator dispatcher according to claim 24, characterized in that said prediction of passenger de-boarding counts for the next short time period of the order of no more than some few minutes using data collected for past like short time periods during that same day providing a real time prediction of said first sequence is based on:

a linear exponential smoothing model.

32. The elevator dispatcher according to claim 26, wherein said short time period is of the order of about a five (5) minute interval.

33. The elevator dispatcher according to either claim 1 or 17, wherein the assignment of sectors is made independently of whether different floors reach maximum traffic volumes at different times.

34. A method for dispatching elevators from a main floor to other contiguous floors in a building, in association with traffic volume measuring means for measuring the traffic volume on a per floor basis at least during up-peak conditions, in response to car calls made at the main floor, and in association with indicating means at the main floor for indicating the intended floor stops for each car, comprising the following steps:

dividing the floors in the building into a plurality of sectors, no greater in number than the plurality of cars, each sector comprising one or more contiguous floors, with the sectors being contiguous with each other, with the floors being assigned to the sectors to at least nearly equalize the total traffic volumes among the sectors during a cycle of a first cyclical assignment sequence that assigns a floor to a sector during one cycle based on estimated traffic volume values based at least in part on the traffic volume related data measured by said traffic volume measuring means measured during the last relatively short period of time of the order of no more than some minutes;

assigning a sector to a car during a cycle of a further cyclical assignment sequence that assigns each sector to a car during one cycle;

allowing a car to move away from the main floor in response to car calls only if the car calls are to floors in the sector assigned to the car; and indicating on the indicating means by car the floors in a sector assigned to that car.

* * * * *